US006030255A

United States Patent [19]

Konishi et al.

[11] Patent Number: 6,030,255

[45] Date of Patent: Feb. 29, 2000

[54] INSULATOR AND HIGH FREQUENCY CONNECTOR

[75] Inventors: Yuichiro Konishi, Tokyo; Hajime Tanisho, Kawasaki; Yuji Koshima, Kawasaki; Teiji Kohara, Kawasaki, all of Japan

[73] Assignee: Nippon Zeon Co., Ltd., Tokyo, Japan

[21] Appl. No.: 08/860,705

[22] PCT Filed: Jan. 31, 1996

[86] PCT No.: PCT/JP96/00179

§ 371 Date: Jul. 23, 1997

§ 102(e) Date: Jul. 23, 1997

[87] PCT Pub. No.: WO96/24177

PCT Pub. Date: Aug. 8, 1996

[30] Foreign Application Priority Data

| | | | |
|---|---|---|---|
| Jan. 31, 1995 | [JP] | Japan | 7-035968 |
| Mar. 30, 1995 | [JP] | Japan | 7-098074 |
| May 31, 1995 | [JP] | Japan | 7-157073 |

[51] Int. Cl.[7] ..... H01R 9/05; H01R 17/04

[52] U.S. Cl. ..... 439/578; 439/933; 174/35 C; 174/137 C; 174/138 B; 174/137 R; 526/280; 526/281; 525/98; 525/240; 525/232

[58] Field of Search ..... 439/933, 578; 174/35 C, 137 B, 138 C, 137 R; 526/280, 281; 525/98, 240, 232

[56] References Cited

U.S. PATENT DOCUMENTS

| | | | |
|---|---|---|---|
| 4,189,392 | 2/1980 | Penneck et al. | 252/63.2 |

FOREIGN PATENT DOCUMENTS

| | | |
|---|---|---|
| 0 303 246 | 2/1989 | European Pat. Off. . |
| 3 200 616 A1 | 8/1983 | Germany . |
| 51-107351 | 9/1976 | Japan . |
| 62 064855 | 9/1985 | Japan . |
| 61-35379 | 3/1986 | Japan . |
| 61-55808 | 3/1986 | Japan . |
| 3-21611 | 1/1991 | Japan . |
| 3-107807 | 5/1991 | Japan . |
| 4-159344 | 6/1992 | Japan . |
| 5-25352 | 2/1993 | Japan . |
| 5-43663 | 2/1993 | Japan . |
| 5-132588 | 5/1993 | Japan . |
| 5-279520 | 10/1993 | Japan . |
| 6-80864 | 3/1994 | Japan . |
| 61-136035 | 5/1994 | Japan . |
| 6-275345 | 9/1994 | Japan . |

*Primary Examiner*—Ana Woodward
*Assistant Examiner*—U. K. Rajguru
*Attorney, Agent, or Firm*—Armstrong, Westerman, Hattori, McLeland & Naughton

[57] ABSTRACT

An insulator for high frequency connectors which comprises a thermoplastic norbornene resin and has a voltage and standing wave ratio of 1.89 or less even in the high frequency band of 2–3 GHz, and a high frequency connector using the insulator.

15 Claims, No Drawings

INSULATOR AND HIGH FREQUENCY CONNECTOR

TECHNICAL FIELD

The present invention relates to an insulator for connectors which is excellent in high-frequency characteristics and a high frequency connector using the insulator, and more particularly to an insulator less in generation of reflection wave at the connecting portions and a high frequency connector using the same.

BACKGROUND ART

With the spread of satellite broadcasting, satellite communication, high-vision telecasting, portable telephones and the like, transmission and reception of high-density information by a radio wave are widely conducted and the frequency of the radio wave used is being increased. With reference to the definition of the term "high frequency", conventionally it means frequency of higher than 3 MHz of HF band which is short wave while it gradually changes to mean the higher frequency such as frequency of higher than 30 MHz of VHF band which is ultrashort wave, that of higher than 300 MHz of UHF band which is microwave and furthermore that of higher than 1–3 GHz which is quasi-microwave band. Thus, the term "high frequency" is not necessarily clear in the frequency meant by it.

In any of the fields of high frequency, the materials to be used are preferably those which are small in dielectric constant and dielectric loss tangent, especially small in the latter in order to reduce transmission loss. If these are great, a part of energy given as high frequency causes intermolecular friction in the materials to lose it as heat. Resins which are small in dielectric constant and dielectric loss tangent include polytetrafluoroethylene, tetrafluoroethylene-perfluoroalkylvinyl ether copolymer resins, polymethylpentene and the like, and these resins are used for high frequency band. Furthermore, recently it is proposed to use thermoplastic norbornene resins.

However, even in the same high frequency fields, problems sometimes occur due to purpose of use and frequency used. Especially, in the high frequency of higher than 1 GHz, when connection is carried out with a connector comprising an insulator made of a resin conventionally used for high frequency band, there is a problem of decrease in output owing to the increase in reflection of input energy at the connecting portions.

As indications which show magnitude of reflection in the resulting insulators, there are voltage and standing wave ratio (VSWR), return loss value (dB) and the like. With the smaller voltage and standing wave ratio and the greater return loss value, the reflection of energy is smaller and the better insulators are obtained. For example, in the case of the frequency of higher than 1 GHz, materials which are considered to be able to be actually used are those of 1.20 or less in voltage and standing wave ratio.

Hitherto, insulators for connectors which are prepared by molding tetrafluoroethylene-perfluoroalkylvinyl ether copolymer resins or polymethylpentene have been practically used. These resins can be subjected to injection molding and have a small dielectric loss tangent of 0.0003 or less and a small dielectric constant of 2.20 or less in the range of 1 MHz–10 GHz. However, at a frequency of 1 GHz or higher, it is difficult to obtain a voltage and standing wave ratio of 1.40 or less in insulators produced from these resins.

Furthermore, in the case of insulators comprising polytetrafluoroethylene which are put to practical use, the dielectric loss tangent is small, namely, 0.0004 or less and further the dielectric constant is also small, namely, 2.10 or less in the range of 1 MHz–10 GHz. Furthermore, insulators having a voltage and standing wave ratio of 1.20 or less at the above frequency can be obtained from the resin. However, this resin cannot be injection molded and is shaped by cutting, and, hence, the problem is that mass-production is difficult.

Moreover, even the insulators made of the same material, upper limit of the usable frequency varies depending on the structure. The smaller insulators can use the higher frequency. Furthermore, when a space is provided in the insulator so as to allow the air having a dielectric constant of 1 to be present and this space is made larger, it can be used at a higher frequency. However, when the space is provided in especially a small insulator, there occurs a problem in strength.

On the other hand, thermoplastic norbornene resins can be injection molded and have a small dielectric loss tangent of 0.0004 or less and a small dielectric constant of 2.25 or less at 1 MHz–10 GHz. However, they have never been actually used as insulators for connectors, and there have been known no examples where the voltage and standing wave ratio was measured at any frequency. Thus, it is utterly impossible to forecast what degree of voltage and standing wave ratio can be obtained in insulators for high frequency band which are made of the thermoplastic norbornene resins.

DISCLOSURE OF INVENTION

The object of the present invention is to provide an insulator for high frequency connectors which can be easily made by injection molding and the like, is small in dielectric loss tangent and dielectric constant and has a voltage and standing wave ratio of 1.20 or less at a high frequency band of 1.4 GHz or higher, and is small in reflection of energy which is input at connecting portions.

BEST MODE FOR CARRYING OUT THE INVENTION

As a result of intensive research conducted by the inventors, it has been found that the desired insulators can be obtained by using thermoplastic norbornene resins as materials of the insulators, and the present invention has been accomplished. Thus, according to the present invention, there are provided high frequency connectors having an insulator which comprises a thermoplastic norbornene resin and has a voltage and standing wave ratio of 1.20 or less at a high frequency band of 1.4 GHz or higher.

(Molding materials)

The molding materials for the insulators of the present invention comprise thermoplastic norbornene resins.

Thermoplastic norbornene resins

Thermoplastic norbornene resins are resins known in JP-A-1-168725, JP-A-1-190726, JP-A-3-14882, JP-A-3-122137, JP-A-4-63807 and others, and specific examples of them are hydrogenated ring opening polymers of norbornene monomers, addition polymers of norbornene monomers, addition polymers of norbornene monomers and olefins, and the like.

The norbornene monomers are also known in the above patent publications and JP-A-2-227424, JP-A-2-276842 and others. As examples of the norbornene monomers, mention may be made of norbornene, alkyl, alkylidene and aromatic group-substituted derivatives of norbornene, and substitution products of these substituted or unsubstituted olefins which have substituents containing elements other than carbon and hydrogen, such as halogen, hydroxyl group, ester group, alkoxy group, cyano group, amide group, imide group and silyl group. Specific examples thereof are 2-norbornene, 5-methyl-2-norbornene, 5,5-dimethyl-2-norbornene, 5-ethyl-2-norbornene, 5-butyl-2-norbornene, 5-ethylidene-2-norbornene, 5-methoxycarbonyl-2-norbornene, 5-cyano-2-norbornene, 5-methyl-5-methoxycarbonyl-2-norbornene, 5-phenyl-2-norbornene, 5-phenyl-5-methyl-2-norbornene, 5-hexyl-2-norbornene, 5-octyl-2-norbornene, 5-octadecyl-2-norbornene, and the like; monomers comprising norbornene to which at least one cyclopentadiene adds and the above-mentioned derivatives and substitution products of these monomers, such as 1,4:5,8-dimethano-2,3-cyclopentadieno-1,2,3,4,4a,5,8,8a-octahydronaphthalene, 6-methyl-1,4:5,8-dimethano-1,4,4a,5,6,7,8,8a-octahydronaphthalene, 1,4:5,10:6,9-trimethano-2,3-cyclopentadieno-1,2,3,4,4a,5,5a,6,9,9a,10,10a-dodecahydroanthracene, and the like; monomers of polycyclic structure which are obtained by polymerization of cyclopentadiene through Diels-Alder reaction and the above-mentioned derivatives and substitution products of these monomers, such as dicyclopentadiene, 2,3-dihydrodicyclopentadiene and the like; adducts of cyclopentadiene with tetrahydroindene or the like and the above-mentioned derivatives and substitution products of these adducts, such as 1,4-methano-1,4,4a,4b,5,8,8a,9a-octahydrofluorene, 5,8-methano-2,3-cyclopentadieno-1,2,3,4,4a,5,8,8a-octahydronaphthalene and the like; and so on.

The number-average molecular weight of thermoplastic norbornene resins used in the present invention in terms of polystyrene is 10,000 or more, preferably 15,000 or more, more preferably 20,000 or more and 200,000 or less, preferably 100,000 or less, more preferably 50,000 or less measured by GPC (gel permeation chromatography) using toluene as a solvent. If the molecular weight is too small, mechanical strength is low and if it is too large, molding becomes difficult.

When unsaturated bonds are contained in the main chain structure like the ring opening polymers of norbornene monomers, it is preferred to saturate the main chain structure by hydrogenation. In the case of carrying out the hydrogenation, the hydrogenation rate of the main chain structure is preferably at least 90%, more preferably at least 95%, especially preferably at least 99%. If the hydrogenation rate is low and the main chain structure has many unsaturated bonds, the polymers are inferior in heat deterioration resistance and sometimes cannot be used for a long period of time, and in addition there occur problems in electric characteristics such as increase in dielectric constant and dielectric loss tangent.

Furthermore the thermoplastic norbornene resins are preferably those which comprise less than 70 mol % of monomers having substituents containing elements other than carbon and hydrogen, so-called polar groups, more preferably those which comprise less than 30 mol % of these monomers, and especially preferably those which comprise none of them. The monomers having many polar groups are apt to cause polarization and readily absorb water, and hence greatly change dielectric loss tangent and increase dielectric constant. Thus, they have problems in electric characteristics, and the resins are not suitable for insulating materials in high frequency band.

Moreover, glass transition temperature (hereinafter referred to as "Tg") of the thermoplastic norbornene resins is preferably 110° C. or higher, more preferably 120° C. or higher, most preferably 130° C. or higher. If Tg is too low, heat resistance of the resins deteriorates.

Silicone-modified polyolefins

The molding materials of the present invention may comprise only the thermoplastic norbornene resins, but slidability can be improved by adding silicone-modified polyolefins as a slidability improver. Especially when connection and disconnection are repeated, it is preferred to use molding materials containing the silicone-modified polyolefins because connection and disconnection are easy to perform.

The silicone-modified polyolefins are not particularly limited as far as they are polymers comprising polyolefin blocks and polysiloxane blocks.

Number-average molecular weight of the polyolefin blocks in terms of polystyrene is usually 10,000 or more, preferably 15,000 or more, more preferably 20,000 or more and usually 200,000 or less, preferably 100,000 or less, more preferably 50,000 or less measured by GPC method. If the molecular weight is small, there occur problems in strength or slidability of molded products and if it is too large, the silicone-modified polyolefins are not uniformly dispersed in the thermoplastic norbornene resins. They contain 50% by weight or more, preferably 70% by weight or more, more preferably 90% by weight or more of recurring structural units derived from olefins such as ethylene, propylene, styrene and the like, and they may contain branched structure, but in general those of straight chain structure are preferred. When they have branched structure or the number of the recurring structural units derived from olefins is too small, the silicone-modified polyolefins sometimes cannot be uniformly dispersed in the thermoplastic norbornene resins.

At least one polysiloxane block bonds to one polyolefin block, and the number-average molecular weight of the polysiloxane block in terms of polystyrene is usually 3,000 or more, preferably 5,000 or more, more preferably 7,000 or more and usually 200,000 or less, preferably 100,000 or less, more preferably 50,000 or less measured by GPC method. If the molecular weight is small, there occur problems in slidability of molded products and if it is too large, the silicone-modified polyolefins are not uniformly dispersed in the thermoplastic norbornene resins. As monomers used for polymerization, mention may be made of octamethyltetrasiloxane, octaethyltetrasiloxane, octapropyltetrasiloxane, hexamethyltrisiloxane, hexaethyltrisiloxane, hexapropyltrisiloxane and the like.

The silicone-modified polyolefins include those which comprise 100 parts by weight of the polyolefin block and, bonded thereto, 1 part by weight or more, preferably 5 parts by weight or more, more preferably 10 parts by weight or more and 200 parts by weight or less, preferably 180 parts by weight or less, more preferably 160 parts by weight or less of the polysiloxane block. Two or more polysiloxane blocks may bond to one polyolefin block. If amount of the polysiloxane is too small, the molded products are inferior in slidability and if it is too large, it becomes difficult to produce insulators and productivity lowers. The number-average molecular weight of the silicone-modified polyolefins used in the present invention in terms of polystyrene is preferably 20,000 or more, more preferably 30,000 or more, especially preferably 40,000 or more and preferably 400,000 or less, more preferably 200,000 or less, especially preferably 100,000 or less measured by GPC method. If the molecular weight is small, there occur problems in slidability of molded products and if it is too large, the silicone-modified polyolefins are not uniformly dispersed in the thermoplastic norbornene resins.

The silicone-modified polyolefins may be obtained by grafting separately prepared polysiloxane blocks on previously prepared polyolefins or by graft polymerizing siloxane monomer in the presence of polyolefin. Alternatively, they may be obtained by polymerizing polyolefins using, as polymeric comonomers, polysiloxane blocks having at a terminal a structure copolymerizable with olefins. In the former case, the polyolefin must have a structure at which the silicone block can bond to the polyolefin and generally a polar group is introduced. The method of introduction of the polar group is not particularly limited, and the introduction can be performed by modification such as terminal modification, use of comonomers having polar group and other methods. In the latter case, for example, a siloxane monomer is polymerized by living anion polymerization method, and the resulting polymeric comonomer to which silyl bromide or the like is bonded at its terminal is copolymerized with polyolefin.

As the silicone-modified polyolefins, there may also be suitably used commercially available silicone-modified polyolefins such as SUMIKASEN SP300 and SUMIKASEN SP310 (which are both manufactured by Sumitomo Chemical Co., Ltd.).

Amount of the silicone-modified polyolefins is 0.5 part by weight or more, preferably 1 part by weight or more, more preferably 5 parts by weight or more and 50 parts by weight or less, preferably 30 parts by weight or less, more preferably 20 parts by weight or less for 100 parts by weight of the thermoplastic norbornene resins. If the amount of the silicone-modified polyolefins is too small, the products are inferior in slidability and if it is too large, electric characteristics are deteriorated.

Soft polymers

The molding materials of the present invention can be improved in impact resistance by adding a soft polymer, and especially when connection and disconnection of connectors are repeated, the resulting insulators hardly undergo impact and are hardly cracked.

The soft polymers used in the present invention are not limited and preferably are those which have a Tg of 40° C. or lower since they are superior in impact resistance. Some block copolymers have two or more Tg, and they are preferred as the soft polymers used in the present invention if one of them is 40° C. or lower. Molecular weight of such copolymers is preferably 10,000 or more, more preferably 20,000 or more, especially preferably 30,000 or more and preferably 400,000 or less, more preferably 300,000 or less, most preferably 200,000 or less. If the molecular weight is too small, mechanical characteristics are inferior and if it is too large, production becomes difficult. Moreover, from the point of compatibility with thermoplastic norbornene resins, non-polar polymers, namely, those comprising only carbon and hydrogen are preferred.

As the soft polymers used in the present invention, mention may be made of random or block copolymers of aromatic vinyl monomers and conjugated diene monomers such as styrene-butadiene block copolymer, styrene-butadiene-styrene block copolymer, styrene-isoprene block copolymer, styrene-isoprene-styrene block copolymer, styrene-butadiene random copolymer and the like; polyisoprene rubbers; polyolefin rubbers such as ethylene-propylene copolymer, ethylene-α-olefin copolymer, propylene-α-olefin copolymer and the like; diene copolymers such as ethylene-propylene-diene copolymer, α-olefin-diene copolymer, diene copolymer, isobutylene-isoprene copolymer, isobutylene-diene copolymer and the like; norbornene rubber-like polymers such as copolymer of a norbornene monomer and ethylene or an α-olefin, tercopolymer of a norbornene monomer, ethylene and an α-olefin, ring opening polymer of a norbornene monomer and the like; and so on. These may be hydrogenated. Preferred are copolymers of aromatic vinyl monomers and conjugated diene monomers because content of metallic elements can be readily reduced, and especially preferred are block copolymers thereof, and furthermore hydrogenation products thereof are preferred because of excellent weathering resistance.

Amount of the soft polymers is 1 part by weight or more, preferably 5 parts by weight or more, more preferably 10 parts by weight or more and 40 parts by weight or less, preferably 30 parts by weight or less, more preferably 20 parts by weight or less for 100 parts by weight of the thermoplastic norbornene resins. If the amount of the soft polymer is too small, impact resistance is inferior and if it is too large, the excellent properties of thermoplastic norbornene resins such as heat resistance and chemical resistance are lost.

Optional components

If necessary, the molding materials of the present invention may contain various additives as far as the effects of the present invention are not lost. Examples of the additives are aging inhibitors such as those of phenolic and phosphorus types; heat deterioration inhibitors such as those of phenolic type; ultraviolet stabilizers such as those of benzophenone type; antistatic agents such as those of amine type; lubricating agents such as partial esters and partial ethers of aliphatic alcohols; resins such as ethylenic polymers; slidability imparting agents such as graphite and fluororesin powders; fillers of low dielectric constant and dielectric loss tangent such as glass fibers; and the like.

Content of metallic elements

Content of the metallic elements in the molding materials used in the present invention is 5 ppm or less, preferably 4 ppm or less, more preferably 3 ppm or less. If the content is too high, the electric characteristics of the molding materials such as dielectric constant and dielectric loss tangent are deteriorated.

These molding materials can be obtained by the following methods. (1) A method of preparing the molding materials by adding to the thermoplastic norbornene resin low in the content of metallic elements, if necessary, the silicone-modified polyolefin, the soft polymer and the like which are low in the content of metallic elements; (2) a method which comprises preparing a solution of molding material using a good solvent which dissolves all the components of the molding material, treating the solution with an adsorbent to remove the metallic elements and then precipitating the molding material in a poor solvent which does not dissolve all of the components of the molding material; (3) a method which comprises repeating the operations of dissolving the molding material in a good solvent and precipitating it in a poor solvent; and the like. In also the method (1), generally the thermoplastic norbornene resin, the silicone-modified polyolefin, the soft polymer and others are made into solutions or treated with an adsorbent at the step of hydrogenation to remove the metallic elements or dissolution in a good solvent and precipitation in a poor solvent are repeated to reduce the content of metallic elements. When an adsorbent is used, this is not particularly limited, but preferred are SiO2 and Al2O3 such as synthetic zeolites, natural zeolites, active alumina, active clay and the like or crystalline or non-crystalline mixed composition thereof. Specific surface area of them is preferably 50 $m^2/g$ or more, more preferably 100 $m^2/g$ or more, especially preferably 200 $m^2/g$ or more and preferably 1000 $m^2/g$ or less, and pore volume there of is preferably 0.5 $cm^3/g$ or more, more preferably 0.6 $cm^3/g$ or more, especially preferably 0.7 $cm^3/g$ or more and preferably 1.5 $cm^3/g$ or less. If the specific surface area and the pore volume are too small, adsorbability is inferior and if they are too large, production becomes difficult.

Blending method

When the molding materials used in the present invention comprise the thermoplastic norbornene resin and other components blended therewith, the method of blending the other components is also not limited, and there may be employed a method of mixing them in the form of solution and precipitating them, a method of kneading by twin-screw kneading extruder, and others.

(Molding method)

In the present invention, the molding material is molded into an insulator for connectors. The molding method is not limited and there may be employed any suitable methods depending on the shape of the insulator. The molding materials used in the present invention are those which can be melt molded, and injection molding, extrusion molding, air-pressure molding, hot press molding and the like are employed. Among them, the injection molding has the features that the molding is easy and molded products high in dimensional accuracy can be obtained.

(Insulators)

The shape of the insulators for connectors of the present invention is selected depending on the shape, purpose and performance of connectors. Explanation will be made of mainly connectors for coaxial cables which are the commonest shapes of connectors.

A connector for coaxial cables generally comprises a central conductor and an outer conductor which are connected or to be connected with a central conductor wire and a peripheral conductor wire of coaxial cable, respectively, an insulator which fixes the central conductor and insulates the central conductor and the outer conductor, and a gasket which insulates the whole. The insulator of connectors for coaxial cables usually has a shape of a cylinder or cylinders of different diameter arranged in the direction of central axis and has a through-hole at the central part to fix the central conductor. The outer peripheral diameter of the insulator of connectors for coaxial cables is preferably 2 mm or more, more preferably 3 mm or more, especially 5 mm or more and 40 mm or less, preferably 30 mm or less, more preferably 25 mm or less. In order to improve especially dielectric characteristics in a high frequency band, the insulator may have a vacant space in addition to the above-mentioned through-hole for fixing of the central conductor. The space is generally a through-hole parallel to the central through-hole and preferably has a circular section. It is preferred to provide an interval of preferably 1 mm or more, more preferably 2 mm or more between the through-holes and between the through-hole and the outer periphery of the insulator.

In an insulator, the reflecting wave becomes greater and the transmission loss increases with the larger sectional area cut at a right angle to the axial direction and with the higher frequency of input wave. From this viewpoint, an insulator for connectors, especially for high frequency which has the smaller sectional area is more preferred. However, if the sectional area is too small, mechanical strength is inferior and the insulator is apt to be broken at the time of connection and disconnection. Moreover, the connector per se becomes smaller, which causes difficulty in use, for example, difficulty to take by hand, and a stress is apt to be applied at the time of connection to result in breakage. Furthermore, in the case of insulators of the same material, size and shape except for the space, those which are higher in the proportion of volume of the space are smaller in the voltage and standing wave ratio at high frequency and can be used even in the band of the higher frequency. However, if the space is too large, the strength of the insulator decreases and it is apt to be broken at the time of connection of cables. Therefore, it is necessary to provide a wall of sufficient thickness between the spaces, the space and the periphery, and the space and the through-hole which is for fixing the central conductor.

The insulator of the present invention has a voltage and standing wave ratio of 1.20 or less in the range of 2–3 GHz. When a slidability improver is added to the thermoplastic norbornene resin and this is used as a molding material, it is excellent in slidability, namely, has a coefficient of dynamic friction of 0.3 or less, preferably 0.27 or less and a wear volume of 0.009 $cm^3$ or less, preferably 0.008 $cm^3$ or less, and is excellent in mechanical strength, namely, has a Young's modulus of 15000 $kgf/cm^2$ or more, preferably 17000 $kgf/cm^2$ or less and a tensile strength of 500 $kgf/cm^2$ or more, preferably 550 $kgf/cm^2$ or more, especially preferably 600 $kgf/cm^2$ or more and usually 750 $kgf/cm^2$ or less, preferably 700 $kgf/cm^2$ or less, especially preferably 650 $kgf/cm^2$ or less, and, furthermore, bleeding hardly occurs on the surface of molded products and appearance of the surface is superior. When a soft polymer is added to the thermoplastic norbornene resin and this is used as a molding material, the molded product has an IZOD impact strength of 4.0 kg.cm/cm or more, preferably 4.5 kg.cm/cm, more preferably 5.0 kg.cm/cm or more and a dielectric constant of preferably 2.60 or less, more preferably 2.55 or less, especially preferably 2.50 or less and a dielectric loss tangent of 0.0015 or less, preferably 0.0012 or less, more preferably 0.0010 or less at 1–20 kHz. Moreover, it has tensile break strength of preferably 450 $kgf/cm^2$ or more, more preferably 500 $kgf/cm^2$ or more, especially preferably 550 $kgf/cm^2$ or more and usually 1000 $kgf/cm^2$ or less, and a tensile break elongation of preferably 45% or more, more preferably 50% or more, especially preferably 55% or more and usually 100% or less.

(Connector)

General connectors include two kinds of male and female or plug and jack which differ in shape, respectively. In the case of coaxial cables, usually the central conductor on male side projects from the insulator and the central conductor on female side is at the bottom of the central through-hole of the insulator, and the central conductors contact with each other by inserting the central conductor of the male side into the through-hole of the female side. Furthermore, the central conductor of the male side is fixed by the through-hole of the female side and thus the male and the female are fixed. In this case, the outer conductors also contact with each other. In general, the outer conductors contact with each other so that the outer conductor of the male side projecting from the insulator covers the outer peripheral surface of the outer conductor which covers the outer side of the insulator of the female side, whereby the male and the female are firmly fixed. Examples of connectors for coaxial cables include those which are described in JIS C5410, C5411, C5412 and others, and typical examples are C01 type connector, C02 type connector and the like. Materials of the central conductors and outer conductors are not limited as far as they have electrical conductivity, and they include those described in the above JIS and examples thereof are silver-plated brass, nickel-plated brass, silver-plated phosphor bronze, silver-plated beryllium copper, gold-plated beryllium copper and the like.

As connectors, there may be used, in addition to the connectors for coaxial cables, those of various shapes depending on uses, for example, RC232C connectors of personal computers for connecting collectively many conductors, connectors for switch terminals used for input and output of image information, and the like. Typical examples thereof are those which differ in shape and size of outer conductors from those of the outer conductors of connectors for coaxial cables and have a plurality of conductor terminals corresponding to the central conductor of connectors for coaxial cables. In any case, when two kinds of connecting portions of male and female are fitted to each other, they fix each other and the corresponding conductors contact with each other, whereby an electric current can be passed. Usually, the conductors are connected to conductor wires by soldering or the like, and to the tip of the wires are connected another connectors, electric circuits, antennas and the like. However, the central conductor and the outer conductor of the connector are not necessarily connected to conductor wires. They may be used only for attaining firm fixing of connectors each other and not connected to any elements, or they may be directly connected to circuits of wiring boards and the connector per se is fixed on the wiring boards. In some cases, two female type connecting portions are integrated, two male type connecting portions are integrated or two kinds of connectors differing in shape as a pair are integrated so that males or females which cannot be connected to each other or connectors differing in shape from each other can be connected indirectly, and thus they are not connected to conductor wires.

EXAMPLES

The present invention will be explained by the following reference examples, examples and comparative examples.

Various properties were measured in the following manner:

Coefficient of dynamic friction: ASTM D1894;

Wear volume: ASTM D1242;

Young's modulus, tensile break strength and tensile break elongation: JIS K7113;

IZOD impact strength: JIS K7110;

Dielectric constant and dielectric loss tangent: JIS K6911 at a frequency of 1 MHz;

Voltage and standing wave ratio: JIS C5402, 5.6.

Content of metallic elements was measured by inductively coupled plasma spectrometry on a sample which had been subjected to wet incineration. The coefficient of dynamic friction was expressed by a mean value of coefficients of dynamic friction on five plate test pieces of 55 mm×90 mm on a straight line of 70 mm in length at the position of 10 mm from edges of lengthwise direction and 17.5 mm, 27.5 mm or 37.5 mm from an edge of crosswise direction.

Example 1

Pellets of a thermoplastic norbornene resin (ZEONEX 280 manufactured by Nippon Zeon Co., Ltd.; a norbornene ring opening polymer hydrogenation product having a number-average molecular weight of about 28,000 in terms of polystyrene measured by gel permeation chromatography, a glass transition temperature of about 140° C., and a hydrogenation rate of at least 99.7%) were injection molded under the following conditions to obtain five No.1 test pieces of JIS K7113 (for measurement of Young's modulus, tensile break strength and tensile break elongation), five No.2 test pieces of JIS K7110 (for measurement of IZOD impact strength), and five test pieces of 55 mm×90 mm with 1 mm thick (for measurement of dielectric constant, dielectric loss tangent, coefficient of dynamic friction and wear volume). Coefficient of dynamic friction, wear volume, Young's modulus, tensile break strength, tensile break elongation, IZOD impact strength, dielectric constant and dielectric loss tangent were measured using these test pieces.

Molding machine: IS-350FB-19A manufactured by Toshiba Machine Co., Ltd.

Clamping pressure: 80 t

Resin temperature: 280° C.

Mold temperature: 100° C. on both the cavity side and the movable platen side.

A connector of the same shape and size as CN C02 SMP2.5 specified in JIS C 5412 except for using an insulator obtained by injection molding the above-mentioned pellets and a central conductor comprising a nickel-plated brass was produced and voltage and standing wave ratio thereof was measured. The results are shown in Table 1.

This connector could be satisfactorily used at a high frequency band, and production of the insulator was easy.

Example 2

To 100 parts by weight of a thermoplastic norbornene resin (ZEONEX 280) was added 5 parts by weight or 10 parts by weight of a silicone-modified polyethylene (SUMIKASEN SP310 manufactured by Sumitomo Chemical Co., Ltd., obtained by grafting polysiloxane on a low-density polyethylene and comprising 40% by weight of low-density polyethylene and 60% by weight of polysiloxane). The mixture was melt extruded by a twin-screw kneading extruder (TEM-35B manufactured by Toshiba Machine Co., Ltd.) at 240° C. to obtain pellets.

Content of metallic elements in these pellets was measured. Furthermore, using the pellets, test pieces were molded in the same manner as in Example 1 except that the thickness of the test pieces of 55 mm×90 mm with 1 mm thick was changed to 3 mm, and coefficient of dynamic friction, wear volume, Young's modulus, tensile break strength, tensile break elongation, IZOD impact strength, dielectric constant and dielectric loss tangent were measured in the same manner as in Example 1. Moreover, connectors were produced by molding insulators in the same manner as in Example 1, and voltage and standing wave ratio was measured using the resulting connectors. The results are shown in Table 1.

These connectors could be satisfactorily used at a high frequency band, and production of the insulators was easy, and slidability was excellent.

Example 3

Pellets were prepared in the same manner as in Example 2 except for using fluororesin powder (LUBRON L-5, a polytetrafluoroethylene having a particle size of 0.5–5 $\mu$m manufactured by Daikin Kogyo Co., Ltd.) in place of the silicone-modified polyethylene, and content of metallic elements was measured. Furthermore, test pieces were molded and coefficient of dynamic friction, wear volume, Young's modulus, tensile break strength, tensile break elongation, IZOD impact strength, dielectric constant and dielectric loss tangent were measured. Moreover, insulators were molded and connectors were produced, and voltage and standing wave ratio was measured using the resulting connectors. The results are shown in Table 1.

These connectors could be satisfactorily used at a high frequency band, and production of the insulators was easy.

Example 4

To 100 parts by weight of a thermoplastic norbornene resin (ZEONEX 280) was added 5 parts by weight, 10 parts by weight or 20 parts by weight of a hydrogenated styrene-ethylene-propylene-styrene block copolymer rubber (SEPTON 2023 manufactured by Kuraray Co., Ltd. and having a number-average molecular weight of 60,000, one Tg being at least present at 40° C. or lower and having a metallic element content of about 15 ppm). The mixture was kneaded by a twin-screw kneading extruder at 240° C. to obtain pellets.

Content of metallic elements in these pellets was measured. Furthermore, using the pellets, test pieces were molded in the same manner as in Example 1, and coefficient of dynamic friction, wear volume, Young's modulus, tensile break strength, tensile break elongation, IZOD impact strength, dielectric constant and dielectric loss tangent were measured in the same manner as in Example 1. Moreover, insulators were molded and connectors were produced in the same manner as in Example 1, and voltage and standing wave ratio was measured using the resulting connectors. The results are shown in Table 1.

These connectors could be satisfactorily used at a high frequency band, and production of the insulators was easy, and slidability was excellent.

Reference Example 1

Twenty parts by weight of an ethylenepropylene-diene trimer rubber (MITSUI EPT 1035 manufactured by Mitsui Petrochemical Co., Ltd. and having a number-average molecular weight of 300,000, one Tg being at least present at 40° C. or lower and having a metallic element content of about 90 ppm) was dissolved in 100 parts by weight of toluene. The solution was thoroughly stirred and then 500 parts by weight of isopropyl alcohol was poured thereinto. The precipitated ethylene-propylene trimer rubber was recovered by filtration and left to stand for 24 hours at 50° C. and at lower than 10 torr and dried, whereby ethylene-propylene-diene trimer rubber was recovered. The content of metallic elements in the recovered rubber was about 45 ppm.

Example 5

Pellets were obtained in the same manner as in Example 4 except that 10 parts by weight of the ethylene-propylene trimer rubber recovered in Reference Example 1 was used in place of the hydrogenated styrene-ethylene-propylene-styrene block copolymer, and molding of test pieces, measurement, molding of insulators, production of connectors and measurement were carried out. The results are shown in Table 1.

Example 6

Pellets were obtained in the same manner as in Example 5 except that 5 parts by weight, 10 parts by weight or 15 parts by weight of the commercially available ethylene-propylene-diene trimer rubber (MITSUI EPT 1035) was used in place of the ethylene.propylene trimer rubber obtained in Reference Example 1. The measurement of metallic element content, molding of test pieces, measurement, molding of insulators, production of connectors and measurement were carried out and the results are shown in Table 1.

Reference Example 2

To 690 parts by weight of dehydrated toluene were added 200 parts by weight of 1,4-methano-1,4,4a,9a-tetrahydrofluorene, 1.1 parts by weight of 1-hexene, 11 parts by weight of 0.3 wt % solution of tungsten chloride in toluene and 0.6 part by weight of tetrabutyltin in a nitrogen atmosphere, followed by carrying out polymerization at 60° C. for 1 hour under atmospheric pressure. The number-average molecular weight (Mn), the weight-average molecular weight (Mw) and the molecular weight distribution (Mw/Mn) of the polymer in the polymerization reaction mixture measured by high performance liquid chromatography using toluene as a solvent (in terms of polystyrene) were 17,700, 35,400 and 2.00, respectively.

To 240 parts by weight of this polymerization reaction mixture were added 6 parts by weight of a nickel catalyst supported on alumina (0.7 part by weight of nickel and 0.2 part by weight of nickel oxide in 1 part by weight of the catalyst; pore volume of alumina: 0.8 $cm^3/g$; specific surface area: 300 $cm^2/g$) and 5 parts by weight of isopropyl alcohol, and reaction was carried out at 230° C. and 45 $kgf/cm^2$ for 5 hours in an autoclave.

The hydrogenation catalyst was removed by filtration and the hydrogenated reaction mixture was poured into a mixed solution comprising 250 parts by weight of acetone and 250 parts by weight of isopropanol with stirring to precipitate a resin, which was recovered by filtration. The resin was washed with 200 parts by weight of acetone and then dried at 100° C. for 24 hours in a vacuum dryer reduced to a pressure of lower than 1 mmHg. The yield was higher than 99%, and the hydrogenation rate of the double bond in the polymer main chain was higher than 99.9% and that of the aromatic ring structure was about 99.8% in accordance with $^1$H-NMR. The number-average molecular weight (Mn), the weight-average molecular weight (Mw) and the molecular weight distribution (Mw/Mn) of the resulting hydrogenation product measured by high performance liquid chromatography using cyclohexane as a solvent (in terms of polystyrene) were 22,600, 42,500 and 1.88, respectively, and it had a Tg of 136° C.

Example 7

Pellets were obtained in the same manner as in Example 1 except that the pellets of resin obtained in Reference Example 2 were used as the thermoplastic norbornene resin. The measurement of content of metallic element, molding of test pieces, measurement, molding of insulators, production of connectors and measurement were carried out and the results are shown in Table 1.

Example 8

Pellets were obtained in the same manner as in Example 4 except that the resin obtained in Reference Example 2 was used as the thermoplastic norbornene resin. The measurement of content of metallic element, molding of test pieces, measurement, molding of insulators, production of connectors and measurement were carried out and the results are shown in Table 1.

Example 9

Pellets were obtained in the same manner as in Example 5 except that the resin obtained in Reference Example 2 was used as the thermoplastic norbornene resin. The measurement of content of metallic element, molding of test pieces, measurement, molding of insulators, production of connectors and measurement were carried out and the results are shown in Table 1.

Example 10

The measurement of content of metallic element, molding of test pieces, measurement, molding of insulators, production of connectors and measurement were carried out in the same manner as in Example 1, except that pellets of ZEONEX 480 (a norbornene ring opening polymer hydrogenation product manufactured by Nippon Zeon Co., Ltd.; having a number-average molecular weight of about 28,000 in terms of polystyrene measured by gel permeation chromatography, a glass transition temperature of about 140° C., and a hydrogenation rate of at least 99.7%) was used as a thermoplastic norbornene resin. The results are shown in Table 1.

Comparative Example 1

A connector of the same shape and size as CN C02 SMP2.5 specified in JIS C 5412 and test pieces were prepared by cutting polytetrafluoroethylene, and coefficient of dynamic friction, Young's modulus, tensile break strength, tensile break elongation, IZOD impact strength, dielectric constant, dielectric loss tangent, and voltage and standing wave ratio were measured. The results are shown in Table 1.

The connector could be satisfactorily used at high frequency band, but production of insulator was difficult because this was carried out by cutting.

Comparative Example 2

Molding of test pieces, molding of insulator, production of connector were carried out in the same manner as in Example 1, except that a polyacetal resin (DURACON manufactured by Poly Plastic Co., Ltd.) was used in place of the thermoplastic norbornene resin, and coefficient of dynamic friction, Young's modulus, tensile break strength, tensile break elongation, IZOD impact strength, dielectric constant, dielectric loss tangent, and voltage and standing wave ratio were measured. The results are shown in Table 1.

Production of the insulator was easy, but it had problems in using at a high frequency band.

TABLE 1

| | Main component of molding material | Slidability imarting agent | | Soft polymer | | Content of metallic elements ppm | Coefficient of dynamic friction |
|---|---|---|---|---|---|---|---|
| | | Kind | Amount based on 100 parts by weight of thermoplastic norbornene resin (part by weight) | Kind | Amount based on 100 parts by weight of thermoplastic norbornene resin (part by weight) | | |
| Example | | | | | | | |
| 1 | ZEONEX | — | — | — | — | <1.0 | 0.37 |
| 2 | 280 | SP 310 | 5 | — | — | 2.4 | 0.25 |
| | | | 10 | — | — | 3.0 | 0.20 |
| 3 | | LUBRON | 10 | — | — | 2.3 | 0.35 |
| | | L-5 | 20 | — | — | 3.8 | 0.30 |
| 4 | | — | — | SEPS | 5 | 1.6 | 0.33 |
| | | | | | 10 | 2.3 | 0.30 |
| | | | | | 15 | 2.7 | 0.27 |
| 5 | | | — | EPDM | 5 | 5.5 | 0.40 |
| 6 | | | | | 10 | 8.6 | 0.45 |
| | | | | | 15 | 11.5 | 0.52 |
| 7 | Resin | — | — | — | — | <1.0 | 0.37 |
| 8 | obtained | | | SEPS | 5 | 1.6 | 0.33 |
| | in | | | | 10 | 2.3 | 0.30 |
| | Reference | | | | 15 | 3.7 | 0.27 |
| 9 | Example 2 | | | EPDM | 10 | 3.3 | 0.45 |
| 10 | ZEONEX 480 | | | — | — | <1.0 | 0.37 |
| Comparative Example | | | | | | | |
| 1 | Polytetra-fluoroethylene | — | — | — | — | Not measured | 0.12 |
| 2 | Polyacetal resin | | | | — | Not measured | 0.13 |

| Wear volume | Young's modulus | Tensile break strength kgf/cm$^2$ | Tensile break elongation % | IZOD impact strength kgf · cm/cm | Dielectric constant | Dielectric loss tangent | Voltage and standing wave ratio 1 GHz | 2 GHz | 3 GHz |
|---|---|---|---|---|---|---|---|---|---|
| 0.018 | 24,000 | 640 | 10 | 3 | 2.35 | 0.0003 | 1.069 | 1.130 | 1.150 |
| 0.007 | 16,800 | 630 | 13 | 3 | 2.35 | 0.0004 | 1.123 | 1.147 | 1.183 |
| 0.004 | 15,100 | 600 | 17 | 5 | 2.35 | 0.0004 | 1.145 | 1.153 | 1.190 |
| 0.007 | 18,000 | 580 | 20 | 2 | 2.35 | 0.0004 | 1.050 | 1.133 | 1.163 |
| 0.010 | 17,700 | 530 | 23 | 2 | 2.35 | 0.0004 | 1.060 | 1.136 | 1.169 |
| 0.020 | 16,300 | 600 | 55 | 10 | 2.37 | 0.0005 | 1.080 | 1.132 | 1.158 |
| 0.021 | 16,200 | 550 | 60 | 15 | 2.38 | 0.0007 | 1.084 | 1.135 | 1.161 |
| 0.023 | 16,000 | 520 | 63 | 18 | 2.39 | 0.0008 | 1.110 | 1.139 | 1.164 |
| 0.025 | 15,300 | 450 | 40 | 9 | 2.54 | 0.0008 | 1.106 | 1.140 | 1.161 |
| 0.023 | 15,600 | 480 | 35 | 5 | 2.85 | 0.003 | 1.160 | 1.182 | 1.183 |
| 0.025 | 15,300 | 450 | 40 | 9 | 2.87 | 0.004 | 1.168 | 1.188 | 1.189 |
| 0.028 | 15,000 | 440 | 42 | 11 | 2.89 | 0.005 | 1.176 | 1.198 | 1.196 |
| 0.019 | 25,000 | 750 | 8 | 2 | 2.37 | 0.0004 | 1.071 | 1.131 | 1.152 |

TABLE 1-continued

| | | | | | | | | | |
|---|---|---|---|---|---|---|---|---|---|
| 0.020 | 17,200 | 650 | 50 | 8 | 2.38 | 0.0006 | 1.082 | 1.134 | 1.159 |
| 0.021 | 16,900 | 600 | 55 | 13 | 2.39 | 0.0008 | 1.088 | 1.137 | 1.163 |
| 0.023 | 16,500 | 570 | 57 | 14 | 2.40 | 0.0008 | 1.112 | 1.140 | 1.165 |
| 0.025 | 15,800 | 550 | 60 | 15 | 2.40 | 0.0009 | 1.172 | 1.195 | 1.198 |
| 0.018 | 24,000 | 640 | 10 | 3 | 2.35 | 0.0003 | 1.069 | 1.130 | 1.150 |
| Not measured | 4,000 | 300 | 200 | 15 | 2.10 | 0.0003 | 1.033 | 1.142 | 1.180 |
| Not measured | 24,000 | 550 | 50 | 5 | 2.67 | 0.003 | 1.363 | 1.588 | 1.786 |

We claim:

1. A high frequency connector for transmission of a high frequency of 1.4 GHz or higher comprising:

a central conductor and an outer conductor which are connected or to be connected with a central conductor wire and a peripheral conductor wire of a coaxial cable, respectively, an insulator which fixes the central conductor and insulates the central conductor and the outer conductor, and a gasket which insulates the whole, wherein the insulator is obtained by molding a molding material comprising a thermoplastic norbornene resin made from a norbornene monomer and has a voltage and standing wave ratio of 1.20 or less at 2–3 GHz, and a dielectric loss tangent of 0.0015 or less at 1 kHz–20 GHz.

2. A high frequency connector which is used for transmission of a high frequency of 1.4 GHz or higher and has an insulator which is obtained by molding a molding material comprising a thermoplastic norbornene resin, having a number-average molecular weight of 10,000–200,000, and which insulator has a voltage and standing wave ratio of 1.20 or less at 2–3 GHz, and a dielectric loss tangent of 0.0015 or less at 1 kHz–20 GHz.

3. A high frequency connector according to claim 1 or 2, wherein the thermoplastic norbornene resin is a polymer containing no elements other than carbon and hydrogen or a hydrogenation product of the polymer.

4. A high frequency connector according to claim 1 or 2, wherein the molding material contains 0.5–50 parts by weight of a silicone-modified polyolefin, having a number-average molecular weight of 10,000 to 200,000 and comprising polyolefin blocks and polysiloxane blocks, for 100 parts by weight of the thermoplastic norbornene resin.

5. A high frequency connector according to claim 4, wherein the silicone-modified polyolefin comprises 100 parts by weight of polyolefin block and 1–200 parts by weight of polysiloxane block bonded to the polyolefin block.

6. A high frequency connector according to claim 4, wherein said insulator has a coefficient of dynamic friction at the surface of 0.3 or less.

7. A high frequency connector according to claim 4, wherein said insulator has a wear volume of 0.009 $cm^3$ or less.

8. A high frequency connector according to claim 4, wherein said insulator has a Young's modulus of 15,000–17,000 $kgf/cm^2$.

9. A high frequency connector according to claim 4, wherein said insulator has a tensile strength of 500–750 $kgf/cm^2$.

10. A high frequency connector according to claim 1 or 2, wherein the molding material contains 1–40 parts by weight of a soft polymer, having at least one polymer with a Tg of 40° C. or lower and a molecular weight of 10,000 to 400,000, for 100 parts by weight of the thermoplastic norbornene resin.

11. A high frequency connector according to claim 10, wherein the soft polymer has a glass transition temperature of 40° C. or lower.

12. A high frequency connector according to claim 10, wherein the soft polymer has a number-average molecular weight of 10,000–400,000.

13. A high frequency connector according to claim 10, wherein said insulator has an IZOD impact strength of 4.0 kgcm/cm or more.

14. A high frequency connector according to claim 1 or 2, wherein the molding material has a content of metallic elements of 5 ppm or less.

15. A high frequency connector which is used for transmission of a high frequency of 1.4 GHz or higher and has an insulator produced from a molding material comprising a thermoplastic norbornene resin and which has a dielectric loss tangent of 0.0015 or less at 1 kHz to 20 GHz.

* * * * *